United States Patent [19]

Bierlich

[11] 4,059,924

[45] Nov. 29, 1977

[54] OPERATING MECHANISM FOR DOORS AND WINDOWS

[76] Inventor: Johannes Harald Bierlich, Oresundshoj 15, Charlottenlund, Denmark

[21] Appl. No.: 703,293

[22] Filed: July 7, 1976

[51] Int. Cl.[2] ..... E05D 15/48

[52] U.S. Cl. ..... 49/192; 49/390

[58] Field of Search ..... 49/192, 193, 390, 153

[56] References Cited

U.S. PATENT DOCUMENTS

| | | | |
|---|---|---|---|
| 3,434,238 | 3/1969 | Muller | 49/192 |
| 3,728,818 | 4/1973 | Lovatt | 49/192 |

FOREIGN PATENT DOCUMENTS

| | | | |
|---|---|---|---|
| 566,791 | 4/1958 | Belgium | 49/192 |

*Primary Examiner*—Philip C. Kannan

*Attorney, Agent, or Firm*—Brisebois & Kruger

[57] ABSTRACT

A window assembly comprises a window sash having a pair of secondary stiles which are hinged to a surrounding frame and at one of their ends to opposite sides respectively of the sash, and operating and locking mechanism including an operating member having three operating conditions whereby in a first of said conditions with the sash in a closed position the operating member locks the sash to the frame, in a second of said conditions the operating member frees the sash from the frame and locks the stiles to the sash to permit tilting of the sash with said stiles from the closed position into a ventilating position and in a third of said conditions the operating member unlocks said stiles from the sash to permit the sash to be rotated horizontally about said one end of said stiles and into a reversed position.

10 Claims, 4 Drawing Figures

OPERATING MECHANISM FOR DOORS AND WINDOWS

This invention relates to a system of operating doors and windows and to an operating and locking mechanism for use with doors and windows and to doors and windows incorporating the said mechanism.

The expression "locking mechanism" is used in the specification and claims in a way commonly used in the building industry to describe a mechanism which, as a result of a positive action by operator, fastens, secures or restrains a member, for example a door or a window, against opening. It does not include fastening devices of the magnetic, spring-loaded or latch bolt type used to fasten a door or window automatically upon closing. The expression "locking mechanism" as used here includes a mechanism employing a dead bolt, i.e. a lock bolt that is moved positively by turning a knob or key without the action of a spring.

Locking mechanism for doors and windows in which a plurality of bolts are operated by a rotatable handle are known and are generally referred to as espagnolette bolt-devices. One form of such a mechanism has been described in my British Patent Specification No. 1349839, together with a window sash which is hinged to project outwardly at its lower end for ventilation and is also pivoted horizontally for rotation.

The mechanism of the present invention is of particular use with a window sash which is hinged to project inwardly at its upper end for ventilation and is also pivoted horizontally for rotation.

In one embodiment of the invention a single operating handle is used to operate the mechanism in such a way that, in a second condition the handle is set to free the sash and enable it to be tilted inwardly to provide ventilation, in a third condition the handle is set to free the sash so that it may be rotated about horizontal pivots to enable its outer surfaces to be cleaned from within a building and in a first condition the handle is set to lock the sash within a surround. In a preferred embodiment the handle occupies the same position during the first and third operating conditions.

In the preferred embodiment there are two sets of bolts both operated by the same operating handle, arranged in such a way that one set projects from the window sash when the other set is withdrawn into the sash. In this embodiment, the bolts of one set are simple longitudinally operated straight bars while those of the other set are curved bars which are guided during their projection against the edge of a slot upon the movement of the operating linkage to withdraw the bolts of the first set into the sash.

In a particular application of the mechanism of the present invention a window sash is mounted upon slidably hinged movable stiles, about the ends of which it is horizontally rotatable and with which it may be tilted for ventilation.

Embodiments of the present invention will now be described with reference to the accompanying drawings in which.

Figure 1:
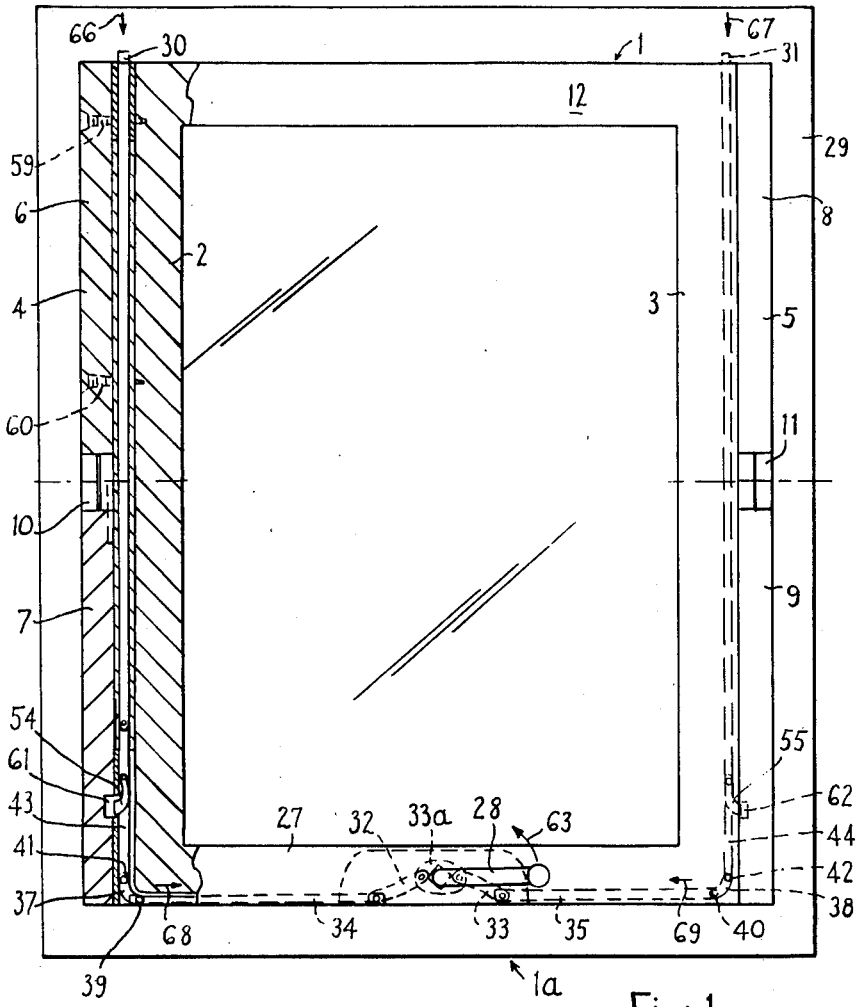
FIG. 1 is a partially cut-away inner elevation of a window sash in a surround.

Referring to the drawings there is shown a window sash 1 having stiles 2 and 3 on the outer side edge of each of which there is a respective secondary stile 4 and 5. Each of these secondary stiles is formed in two parts 6, 7 and 8, 9. The part 6 may, in fact, be made in one piece with the stile 2 and the part 8 may be made in one piece with the stile 3. The parts 6 and 7 and the parts 8 and 9 are coupled together through horizontal pivot hinges 10 and 11 and, under certain conditions to be described below, the end of the sash 1 defined by its upper rail 12 may be rotated inwardly about the pivot hinges 10 and 11. Pivot hinges of this type are described in FIGS. 7 and 8 of my British Patent Specification No. 1358982.

Figure 2:
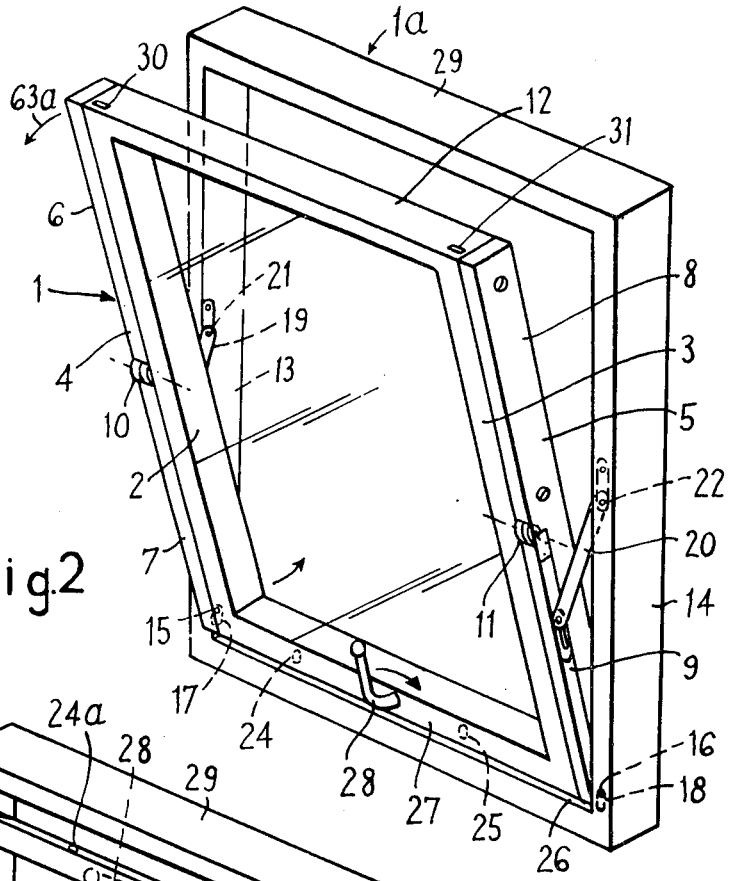
FIGS. 2 and 3 are perspective views of the window sash of FIG. 1 in the surround, showing the sash in a ventilating position and during its rotation about horizontal pivots respectively
Figure 3:
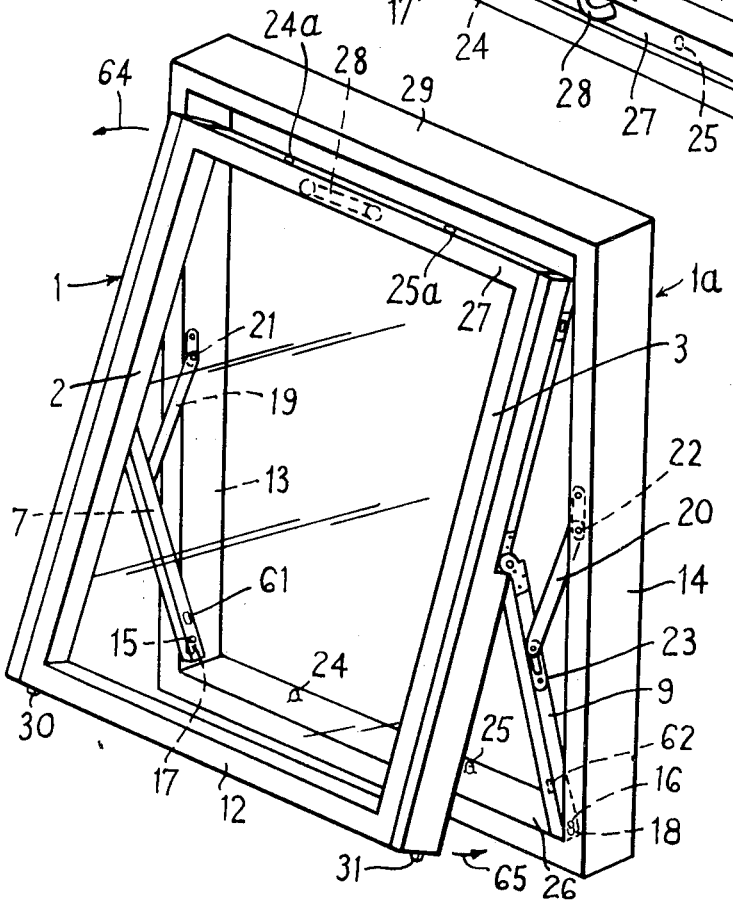

From FIGS. 2 and 3 it may be seen that the parts 7 and 9 of the secondary stiles 4 and 5 are coupled to the respective adjacent jambs 13 and 14 of the window sash surround 1*a* by a sliding pivot system which includes pins or studs 15 and 16 extending inwardly from the jambs 13 and 14 and engaging slots 17, 18 in plates fixed to the sides of the parts 7 and 9. The parts 7 and 9 are also coupled to the jambs 13 and 14 by stays 19, 20 each of which is pivotally connected at one of its ends to one of the jambs 13 or 14 respectively, as shown at 21, 22. The other end of each of the stays 19, 20 is coupled to the respective part 7 and 9 by sliding pivots provided by pins or studs projecting inwardly from the stays into slots in plates, one of which is visible at 23, on the part 9. Studs 24, 25 are positioned to extend upwardly from the sill 26 of the sash surrounded to co-operate with corresponding insets 24*a*, 25*a* in the bottom rails or bar 27 of the sash 1.

In addition to the fittings already described, the sash 1 is provided with a locking bolt arrangement operated by a handle 28 through a linkage which is, in some ways, similar to that described in my British patent specification No. 1349839.

Figure 4:
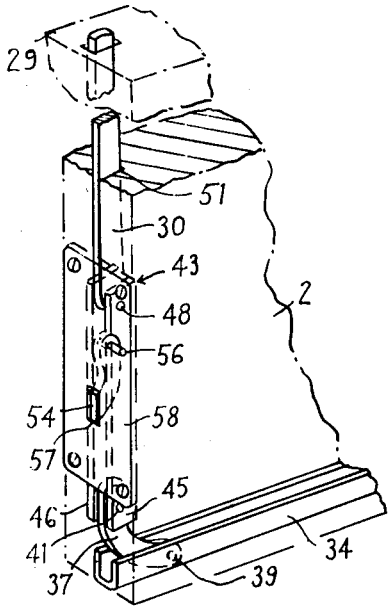
FIG. 4 is a diagrammatic perspective cut-away view of a part of the locking bolt mechanism of the window of FIG. 1.

The present linkage and locking bolt arrangement is best seen in FIGS. 1 and 4 of the accompanying drawings in which upper bolts 30 and 31 extend(as indicated) from the upper rail 12 of the sash when the handle 28 is in the horizontal position and are able, when the sash is closed to engage insets, not shown, in the head 29 of the window sash surround 1*a*. The handle 28 is coupled to the bolts 30 and 31 via levers 32 and 33 each pivoted at one end to a plate 33*a*, acting as a crank, attached to the operating rod of the handle 28 and at the other end to connecting rods 34, 35 formed from sheet material bent into a U shape. The rods 34 and 35 may be guided for longitudinal movement in a tubular housing formed from bent sheet material. Such a housing, together with its rod, is easily held in a groove in the bottom rail of the sash by screws passing through the housing and slots in the rods 34 and 35. Curved angle links 37 and 38 are pivotally coupled at 39 and 40 to the rods 34 and 35 and coupled the longitudinal movements of the connected rods 34 and 35 through right angles by means of pivotal connections 41 and 42 to linkages 43 and 44, which are longitudinally movable at right angles to the rods 34 and 35 housings (not shown). The linkages 43 and 44 each consist of two bars between which is curved bolt is pivotally suspended. The linkages 43 is shown in detail in FIG. 4 to consist of bars 45 and 46 pivotally connected at 41 to the link 37. The bars 45 and 46 are pivotally connected near to their other ends at 48 to the bolt 30, which is movable in a slot 51 in the stile 2. The bolt 31 movable in a similar slot in the stile 3 is coupled to the linkage 44 in a similar way. The linkages 43 and 44 each pivotally support a respective curved bolt 54 and 55, which is guided through a slot in a cover plate, as may be seen from FIG. 4, where the bolt 54 is supported on a pivot 56 between the bars 45 and 46 and extends through a slot 57 in a plate 58 screwed across the part of the slot 51 housing the linkage 43. The bolts 30 and 31 are held in their parts of the slots 51 and 53 by the stile parts 6 and 8 which are screwed to the stiles 2 and 3 in the way indicated at 59 and 60 in FIG. 1.

Insets 61 and 62 (FIG. 1) are provided in the secondary stile parts 7 and 9 opposite to the slots e.g. 57 in the plates through which the bolts 54 and 55 project thereby enabling the curved bolts 54, 55, when operated to project through the slots into the insets 61, 62, to lock the window sash 1 to the secondary stile parts 7 and 9.

In operation the window may be opened to the ventilating position shown in FIG. 2 by first moving the handle 28 to the vertical position from the position shown in FIG. 1 in the direction of the arrow 63 to the position shown in FIG. 2. This action causes the linkage mechanism to be operated to withdraw the bolts 30 and 31 into the top rail 12 of the window sash 1, thereby freeing the upper end of the sash, and to cause the curved bolts 54 and 55 to engage the insets 61 and 62 thereby locking the sash 1 to the movable intermediate stile parts 7 and 9. The window sash may then be opened by grasping it near to its upper rail 12 by means of a grip or handle (or shown) and tilting the sash inwards about the sliding pivots 15 to 18 and under the control of the stays 19, 20. The action of the stays 19, 20 is to cause the sash to be raised as it is tilted inwards, thereby lifting the bottom rail 27 off the studs 24, 25 on the sill 26, and providing a ventilation space between the sill 26 and the bottom rail 27 of the sash 1.

The sash 1 may be tilted inwardly to any position up to the widest opening position determined by the lengths of the slots 17, 18 and of the stays 19, 20.

In order to rotate the sash about the pivots 10 and 11 so that it is reversed and the outside of any glass in the sash may be cleaned from inside a building, the handle 28 is restored to the position shown in FIG. 1, with the sash in the open ventilating position. This action causes the linkage and locking bolt arrangement to be operated to extend the bolts 30 and 31 from the upper rail 12 of the sash 1 and to withdrawn the curved bolts 54 and 55 from engagement with the insets 61, 62 in the respective stile parts 7 and 9. The sash is now free, not only of the sash surround which includes the jambs 13 and 14, the sill 26 and the head 29, but also of the secondary stile parts 7 and 9. To rotate the sash 1 it is now only necessary to continue to move the upper rail 12 of the sash 1 inwardly in the direction of the arrow 63*a* of FIG. 2 whereupon the tilting movement of the sash about the sliding pivots 15, 16, 17 and 18 is changed into a turning movement about the pivots 10 and 11 and the position shown in FIG. 3 is reached. This rotational movement may be continued, as indicated by the arrows 64 and 65 in FIG. 3 until the fixed stile parts 6 and 8 of the sash are adjacent the movable stile parts 7 and 9 respectively and the sash is tilted inwardly in a reversed position thereby enabling its outer surface to be cleaned in a comparatively easy manner.

In order to close the window the sash is rotated in the reverse direction from that necessary to reach the position shown in FIG. 3 until the position shown in FIG. 2 is reached. In this FIG. 2 position the handle 28 is rotated from the horizontal to the vertical position shown in FIG. 2, thereby causing the linkage mechanism to move in the directon of the arrows 66 to 69 shown in FIG. 1 so that the bolts 30 and 31 are withdrawn into the upper rail 12 and the curved bolts 54, 55 are guided by the sides of the slots in the plates e.g. slot 57 in plate 58 to project from the sides of the stiles 2 and 3 into the insets 61, 62 in the stile parts 7 and 9.

From this position the window sash may be closed by pushing the upper rail 12 of the sash towards the window surround under the control of the sliding pivot systems 15, 16, 17 and 18 and the stays 19, 20. The lower rail 27 of the sash is thus able to sit down on the sill 26, where it is located by the studs 24 and 25 which enter the insets (not shown) in the bottom rail 27. The restoring movement is continued until the remainder of the sash locates within the surround whereupon the handle 28 is rotated in the direction of the arrow in FIG. 2 thereby causing the bolts 30 and 31 to engage the insets (not shown) in the head 29 of the surround. This action, although it releases the sash 1 from the stile parts 7 and 9 by virtue of the withdrawal of the curved bolts 54 and 55 into the stiles 2 and 3, results in the complete locking of the sash to the surround since the bottom rail 27 is already locked to the sill 26 by virtue of the studs 24 and 25.

It can thus be seen that a comparatively simple locking mechanism, operated by one handle, may be used to control the movement of the sash in either a tilting ventilating action or a turning action to enable cleaning to be performed.

Although a particular embodiment of the invention has been described, it will be appreciated that modifications thereof may be made without departing from the scope of the present invention as defined by the appended claims.

I claim:

1. A window assembly comprising a window sash, a surrounding frame, the sash having a pair of secondary stiles which are hinged to the frame and to opposite sides respectively of the sash so that the sash can be tilted with said stiles from a closed position into a ventilating position and can be rotated horizontally about one of the ends of said stiles into a reversed position, and the assembly further comprising operating and locking mechanism including an operating member which in a first condition with the sash in the closed position locks the sash to the frame, in a second condition frees the sash from the frame and locks said stiles to the sash to permit tilting of the sash to the ventilating position and in a third condition with the sash in the ventilating position unlocks said stiles from said sash to permit rotation of the sash with respect to said stiles.

2. An assembly as claimed in claim 1, wherein the operating member occupies the same position during the first and third operating conditions.

3. An assembly as claimed in claim 2, wherein said mechanism includes two sets of locking bolts which are operated by said operating member such that one set of bolts projects from the sash when the other set is withdrawn into the sash.

4. An assembly as claimed in claim 3, wherein the bolts of one set are straight bars which are operated longitudinally to lock the sash to the frame and the bolts of the other set are curved bars which are guided against the edges of respective slots in said opposite sides of the sash to lock said stiles to the sash.

5. An assembly as claimed in claim 4, wherein the operating member is connected to the straight bars by respective linkages which each include a first coupling member connected to one of the straight bars, a second coupling member connected to the operating member by a lever and a link connected between the first and second coupling members to translate the direction of movement of the said first bolt to the direction normal thereto, and said curved bars are pivotally connected to the first coupling members respectively such that in the second condition of the operation member said curved bars project through said slots and engage in recesses in said stiles.

6. An assembly as claimed in claim 1, and including, between said stiles on one of the sash and the frame, studs which engage in recesses in one of the frame and sash in the closed position of said sash and disengage from the recesses in the ventilating position.

7. An assembly as claimed in claim 1, wherein the stiles are hinged to the frame by a slidable pivot system which includes pin and slot connections between the other ends of the stiles and the frame and stays which are pivoted to the stiles intermediate their ends.

8. An assembly as claimed in claim 1, wherein the said mechanism is housed in grooves or channels in the window sash.

9. An assembly as claimed in claim 1, wherein in the closed and ventilating positions of the sash said secondary stiles nest in and form respective parts of the sides of the window sash.

10. A window assembly including a window sash surrounded by a relatively fixed frame, the sash including secondary stiles between each of two opposite sides of the sash and the frame, a hinge providing a connection between one end of each secondary stile and one of the said sides of the sash, a slidable connection system between each secondary stile and the frame, and an operating and locking mechanism housed in the sash and including a rotatable operating member, a first locking bolt engageable in the frame and two second locking bolts engageable in respective ones of the secondary stiles, wherein with the sash in the closed position within the frame the operating member is rotatable in one direction to cause the first locking bolt to engage the frame, and in the other direction to cause the first locking bolt to disengage the frame and the second locking bolts to engage said secondary stiles respectively to permit tilting of the sash about said slidable connection system and into an open position in which it projects inwardly from the frame for ventilation, and with the movable member in the open position the operating member is rotatable to cause the second locking bolts to disengage the respective secondary stiles to permit rotation of the sash with respect to said stiles about said hinges for reversing said sash.

* * * * *